US006027819A

United States Patent [19]

Mosely

[11] Patent Number: 6,027,819

[45] Date of Patent: Feb. 22, 2000

[54] BLANKS FOR FORMING HOLLOW OBJECTS WITH SYMETRICALLY PLACED CONICAL DEPRESSIONS AT OPPOSITE ENDS OF MAJOR DIAGONAL AXES THEREOF AND PRODUCTS PRODUCED THEREFROM

[76] Inventor: Jeannine Mosely, 32 Poplar, Belmont, Mass. 02178-4427

[21] Appl. No.: 09/056,478

[22] Filed: Apr. 6, 1998

[51] Int. Cl.[7] ..... B29B 7/00; A63H 33/00; B31B 1/14

[52] U.S. Cl. ..... 428/542.8; 428/9; 428/34.1; 428/174; 428/187; 428/195; 446/488; 493/356; 493/405

[58] Field of Search ..... 428/9, 34.1, 58, 428/156, 167, 195, 542.2, 542.8, 187, 174, 178, 7; 446/487, 488; 40/539; 493/355, 356, 4.3, 4.5

[56] References Cited

U.S. PATENT DOCUMENTS 3,042,562 7/1962 Peterson ..... 428/167
3,302,321 2/1967 Walker ..... 46/1
3,730,818 5/1973 Salinari ..... 428/9
4,001,964 1/1977 Hooker ..... 52/86
4,517,251 5/1985 Mosely ..... 428/542.8

*Primary Examiner*—Donald Loney
*Attorney, Agent, or Firm*—Neal J. Mosely

[57] ABSTRACT

A blank of foldable sheet material for assembling a hollow figure having inwardly directed conical depressions comprises a sheet of foldable material having the shape of a square or rectangle, without interior cuts or exterior tabs scored or marked for scoring in four areas along circular lines tangential to each other and having a radius of one fourth the diagonal of the sheet if a square and one half the narrower side if a rectangle. The blanks have each of the circularly scored areas formed by rolling into a conical shape comprising from about four-ninths to two-thirds of a cone. Six of the blanks assemble into a self-supporting interlocking hollow figure having eight inward-facing cones. If desired, the visible surfaces of the hollow object may have a decorative or informative imprint or coating thereon.

12 Claims, 4 Drawing Sheets

BLANKS FOR FORMING HOLLOW OBJECTS WITH SYMETRICALLY PLACED CONICAL DEPRESSIONS AT OPPOSITE ENDS OF MAJOR DIAGONAL AXES THEREOF AND PRODUCTS PRODUCED THEREFROM

BRIEF SUMMARY

BACKGROUND OF THE INVENTION

Field of the Invention

This invention relates to new and useful improvements in blanks for folding and paper or other sheet material into a decorative shape with conical depressions symmetrically placed at opposite ends of major diagonal axes thereof.

DESCRIPTION OF THE PRIOR ART

The following U.S. Patents are illustrative of the art of forming hollow three-dimensional figures by folding and manipulating paper or other sheet material:

Warren U.S. Pat. No. 2,633,657 discloses an octahedral pyramidal ornament and a sheet material blank for folding the same.

Woolven U.S. Pat. No. 3,093,461 discloses a stellated ornament and a multiple part blank for folding the same.

Jannes U.S. Pat. No. 3,267,597 discloses a blank for folding a hollow display.

Walker U.S. Pat. No. 3,302,321 discloses a multi-part blank for folding into an ornament.

Salinari U.S. Pat. No. 3,730,818 discloses a two-part blank for folding an octahedral ornament.

Benjamin U.S. Pat. No. 3,878,638 relates to a construction game and more specifically to an educational construction game wherein a sheet of foldable material bearing sequentially coded indicia pairs is folded and creased to bring corresponding members of the sequentially coded indicia pairs into superimposing contact with one another for construction of a finished article.

Hooker U.S. Pat. No. 3,894,352 shows folded structures which are polyhedrons of generally toroidal shape, movable to various different stable configurations, made up of a series of hinged triangles.

Hooker U.S. Pat. Nos. 4,001,964 and 4,227,334 show folded structures that are polyhedrons of generally toroidal shape, movable to various different stable configurations, made up of a series of hinged trapezoids.

Transport U.S. Pat. No. 4,319,418 shows a versatile collapsible ornamental solid having a fully enclosed hollow interior cut from a single sheet of paper or similar material, folded and bonded, and encircled by an elastic band.

Mosely U.S. Pat. No. 4,517,251 shows a blank of foldable sheet material for folding a regular octahedron scored or marked for scoring along lines subdividing said hexagon into 24 equilateral triangles of equal size, each having sides one half the length of a side of said hexagon. Successive folding of apexes of the blank along score lines ending with the tucking of one final flap into another produces an octahedron held together by the folds and final tuck without need for adhesives or other securing means. The sheet of foldable material may a surface imprint or decorative coating on the portions thereof visible when folded into an octahedral shape and may have surface imprints comprising indicia and instructions for folding into an octahedral shape.

Mage U.S. Pat. No. 4,788,109 shows a decorative display device that is capable of being folded from a relatively flat single sheet of material into a three-dimensional object. The sheet of material is embossed on its flat front face such that embossed segments project outwardly beyond the surface of the sheet with respect to non-embossed segments.

Jones U.S. Pat. No. 5,314,112 shows a folder, for storing flat sheet articles, formed from a one-piece sheet material blank to provide a rectangular container which is fabricated by appropriately folding a rectangular blank and does not require any fasteners, and structured in a manner that it may be collapsed about the articles to be stored in a way that completely captivates the articles.

Cartmell U.S. Pat. No. 5,365,684 shows a method of constructing an origami-style of foldable picture frame.

Gavula U.S. Pat. No. 5,489,230 shows a geometric construction set having a number of blanks where each blank includes four contiguous triangular sections designed to facially interconnect with other matching blanks allowing the construction of a large variety of triangular polyhedra.

Wagner U.S. Pat. No. 5,564,207 shows a placard for a curved object made from a sheet of material having fist and second continuous edges and slits extending across a portion of the sheet. The continuous edges of the sheet may be brought together to form a flexible base for a placard that may be affixed to a curved object, such as a basket handle.

SUMMARY OF THE INVENTION

One of the objects of this invention is to provide new and improved blanks for folding sheet material into a form for assembly into a hollow shape with symmetrically spaced indentations.

Another object of this invention is to provide new and improved square or rectangular blanks creased for folding into a form for assembly into a hollow shape with symmetrically spaced indentations.

Still another object of this invention is to provide new and improved blank having square or rectangular portions creased for folding into a form for assembly into a hollow shape with symmetrically spaced indentations and having a surface imprint or decorative coating on at least the portions thereof visible when assembled.

Another object of this invention is to provide an improved ornament or novelty item having a hollow shape with symmetrically spaced indentations.

Still another object of this invention is to provide an improved ornament or novelty item having a hollow shape with symmetrically spaced indentations and having a surface imprint or decorative coating on at least the portions thereof visible when assembled.

Other objects of the invention will become apparent from time to time through-out the specification and claims as hereinafter related.

DESCRIPTION OF A PREFERRED EMBODIMENT

Figure 1:
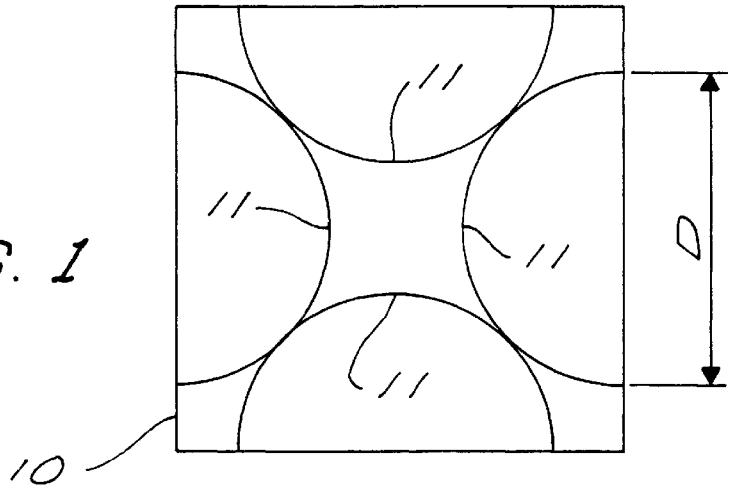
FIG. 1 is a plan view of a square sheet material blank ruled or scored for folding in accordance with this invention.
Figure 2:
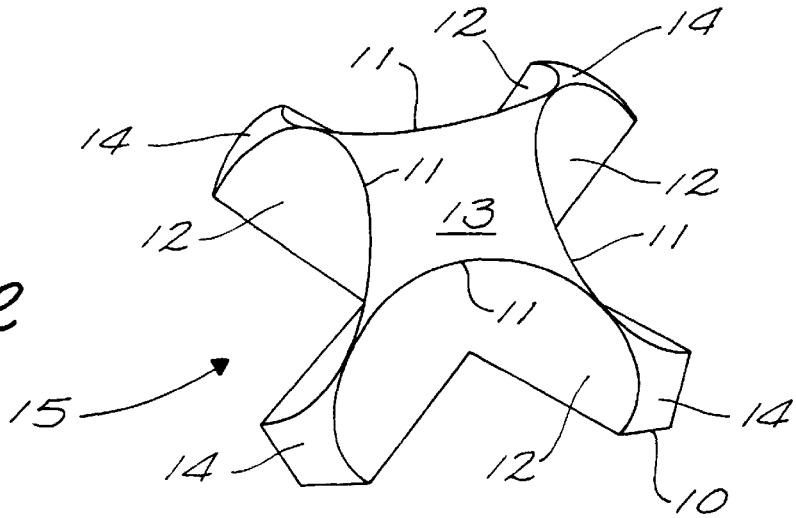
FIG. 2 is an isometric view of the square blank shown in FIG. 1 formed with four conical indentations providing a module for assembly in accordance with this invention.

Referring to the drawings by numerals of reference and more particularly to FIG. 1, there is shown a sheet material blank which may be of paper, cardboard, sheet plastic, metal foil, or the like. Card stock, such as that used for business cards is particularly useful. Blank 10 is designed for forming into a module in the shape of a hollow figure as shown in FIG. 2. Blank 10 is of square shape of suitable card stock. Blank 10 is creased or scored along four circular lines 11 each having a diameter D equal to one half the diagonal of the blank. The circularly scored lines 11 are centered on each edge of the square card and are tangential to each other as shown in FIG. 1.

Each circularly scored line 11 is rolled to form a partial cone 12, viz., two-thirds of a cone or 240°. The resulting shape is shown in FIG. 2 having 240° cones 12 spaced equally around blank 10 and central portion 13 and peripheral edge areas 14 being of substantially spherical curvature. The shape is a module 15 for assembly into the hollow figure 16 shown in FIG. 5.

The folding of blank 10, as shown in FIG. 2, produces module 15 and six of the modules 15 assemble into hollow figure 16 as will be described below. When modules 15 are assembled, peripheral edge areas 14 are overlapped over an edge of central portion 13 which results in the cones 12 overlapping over about one third of each cone to form inward-facing cones 12*a* in the assembly.

Figure 3:
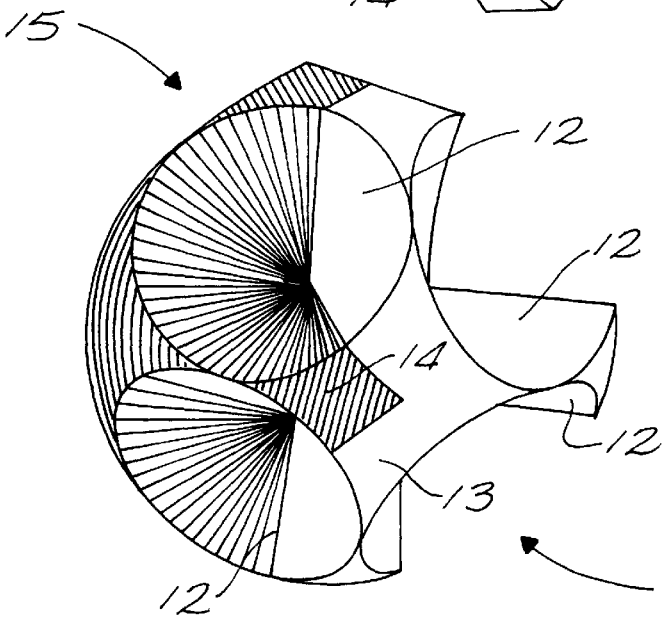
FIG. 3 is an isometric view of two of the blanks as shown in FIGS. 1 and 2 after the first step in assembly.

In the first step of assembly (FIG. 3), two of the modules 15 are fitted together with one peripheral edge area 14 overlapping the edge portion of central portion 13 and cones 12 partially overlapped. Since these overlaps extend in four directions from each module, the overlaps are alternated from one module to the next so that an interlock results that holds the final assembly of hollow figure 16 together as seen in FIG. 5.

Figure 4:
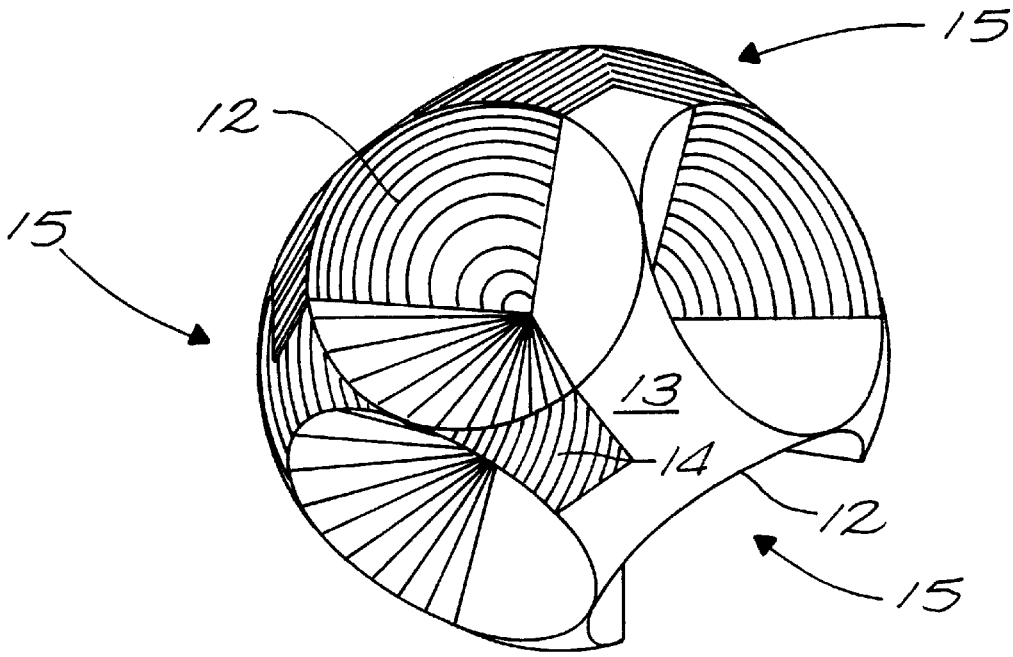
FIG. 4 is an isometric view of three of the blanks as shown in FIGS. 1 and 2 after the second step in assembly.

In the second step of assembly (FIG. 4), a third module 15 is fitted together with the two assembled modules from the first step with one peripheral edge area 14 overlapping the edge portion of central portion 13 and cones 12 partially overlapped. As noted above, these overlaps extend in four directions from each module and are alternated from one module to the next so that an interlock results that holds the final assembly of hollow figure 16 together as seen in FIG. 5.

Third, fourth, fifth and sixth steps are carried out in succession with one peripheral edge area 14 overlapping the edge portion of central portion 13 and cones 12 partially overlapped. Each module 15 has a peripheral edge area 14 overlapping the edge portion of central portion 13 of an adjacent module 15 on one side and in turn has an edge portion of central portion 13 overlapped by an edge portion 14 of an adjacent module on another side. The alternate overlapping on adjacent modules produces a self-supporting assembly. In assembling the modules 15 in this manner, not only are the portions 13 and 14 overlapped but also the cones are overlapped by about one-third on each side.

Figure 5:
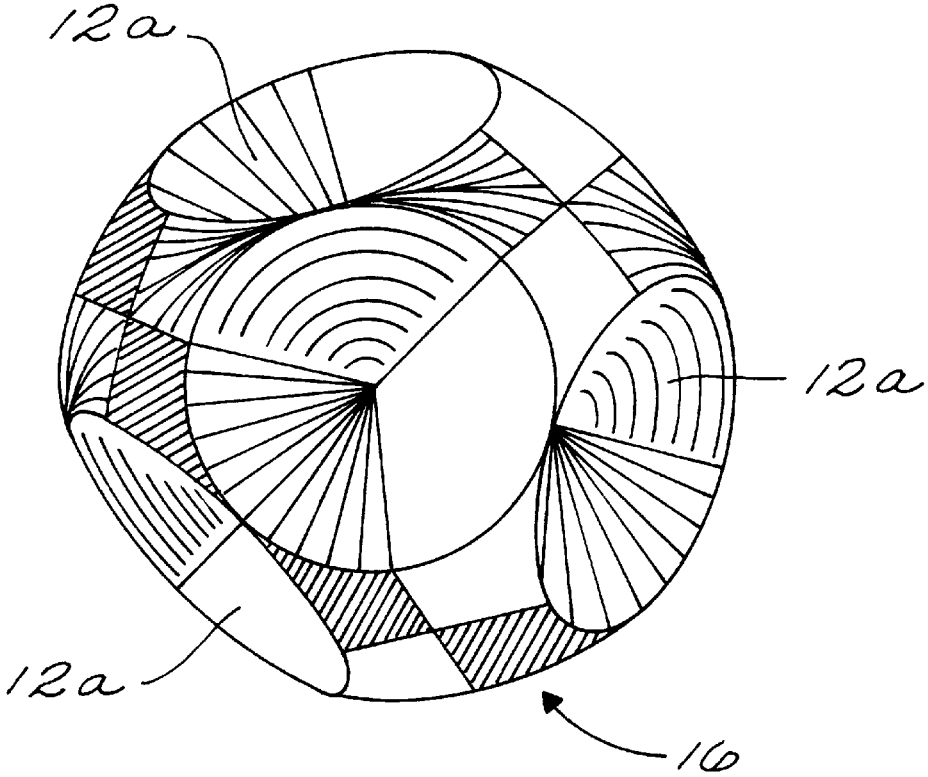
FIG. 5 is an isometric view of the completed hollow figure with symmetrical conical indentations formed after assembling six of the blanks in the same manner as the first and second steps shown in FIGS. 3 and 4.

The final assembly is shown in FIG. 5 where six of the modules 15 are assembled into hollow figure 16. The figure 16 has a substantially spherical shape on its outermost surface, approximating an octahedron in shape with cones 12*a*, formed by overlapping assembly of cones 12, extending inwardly of each corner of the octahedron.

The sequence of steps described above is more or less critical to the production of a hollow figure 16 with interior-facing cones 12*a* as shown and described above. The diameter of circular scoring 11 must be one half the diagonal of the square card 10 and centered on each edge thereof, but in the purest mathematical form the arcs are smooth curves that may differ from a true circle by up to 5% depending on whether one wants the bases of the cones to be planar. For commercial applications, the blanks 10 may have a surface imprint or decorative coating on at least the portions thereof visible when assembled into the hollow figure 16.

DESCRIPTION OF ANOTHER PREFERRED EMBODIMENT

Figure 6:
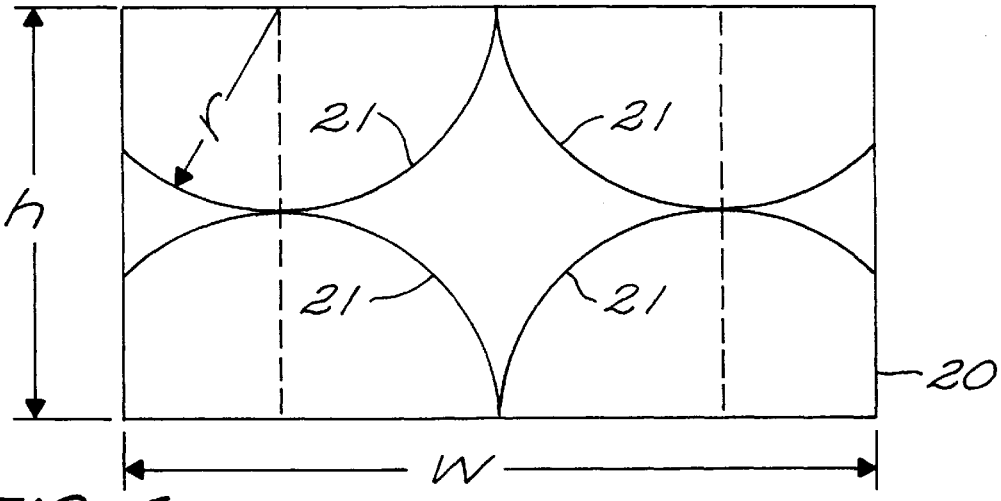
FIG. 6 is a plan view of a rectangular sheet material blank ruled or scored for folding in accordance with this invention.
Figure 7:
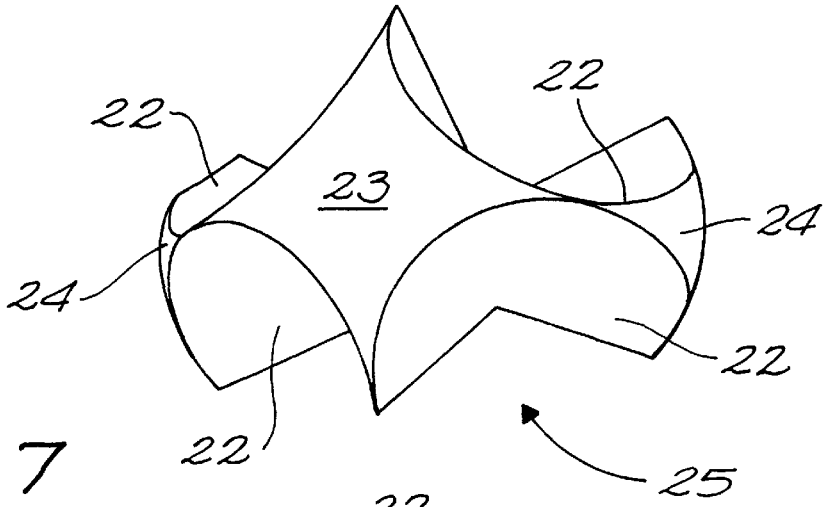
FIG. 7 is an isometric view of the rectangular blank shown in FIG. 6 formed with four conical indentations providing a module for assembly in accordance with this invention.
Figure 8:
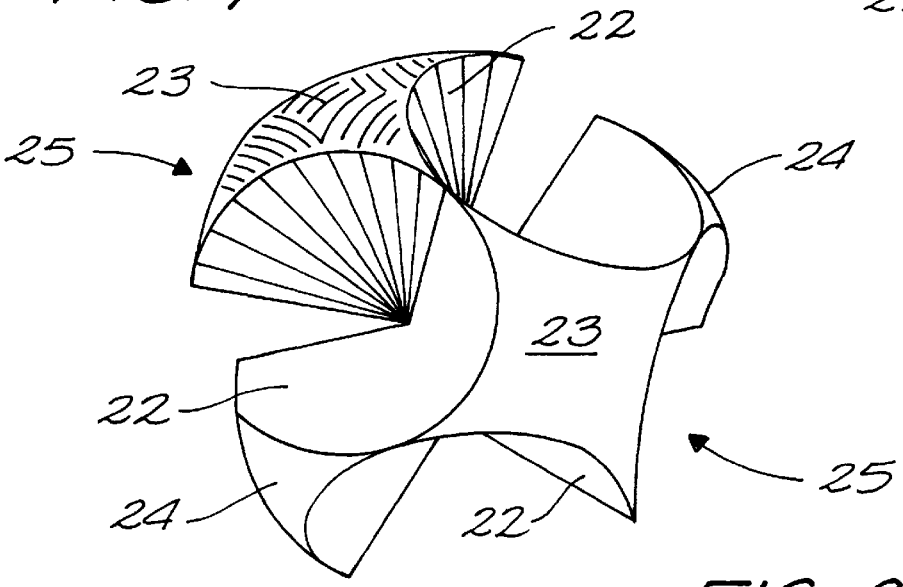
FIG. 8 is an isometric view of two of the blanks as shown in FIGS. 6 and 7 after the first step in assembly.

Referring to the drawings by numerals of reference and more particularly to FIG. 6, there is shown a sheet material blank which may be of paper, cardboard, sheet plastic, metal foil, or the like. Card stock, such as that used for business cards is particularly useful. Blank 20 is designed for forming into a module in the shape of a hollow figure as shown in FIG. 7. Blank 20 is of rectangular shape of suitable card stock. The width w of rectangular blank 20 is from 1.5 to 2.0 times the height h as shown in FIG. 6. Widths w which are less than 1.5 h or greater than 2.0 h produce shapes, on assembly, that are not coherent and self-supporting and thus are substantially inoperative.

Blank 20 is creased or scored along four circular lines 21 each having a radius r equal to one half the height h of the blank. The circularly scored lines 21 are centered on the width of the rectangular card and are tangential to each other as shown in FIG. 6. It is noted that circularly scored lines 21 are formed along opposite edges (width w) of the rectangle rather than spaced one on each side as the case of a square card. The circularly scored lines 21 are thus incomplete semi-circles rather than full semi-circles.

Each circularly scored line 21 is rolled to form a partial cone 22, viz., 160° to 240° of a cone as w/h varies from 1.5 to 2.0. The resulting shape is shown in FIG. 7 having 240° cones 22 spaced equally along the width w of blank 20 and central portion 23 and peripheral edge areas 24 being of substantially spherical curvature. The shape is a module 25 for assembly into the hollow figure 26 shown in FIG. 10.

The folding of blank 20, as shown in FIG. 6, produces module 25 and six of the modules 25 assemble into hollow figure 26 as will be described below. When modules 25 are assembled, peripheral edge areas 24 are overlapped over an edge of central portion 23 which results in the cones 22 overlapping over about one third of each complete cone 22*a*.

In the first step of assembly (FIG. 7), two of the modules 25 are fitted together with one peripheral edge area 24 overlapping the edge portion of central portion 23 and cones 22 partially overlapped. These overlaps extend in two directions from each module, the overlaps are alternated from one module to the next so that an interlock results that holds the final assembly of hollow figure 26 together as seen in FIG. 10.

Figure 9:
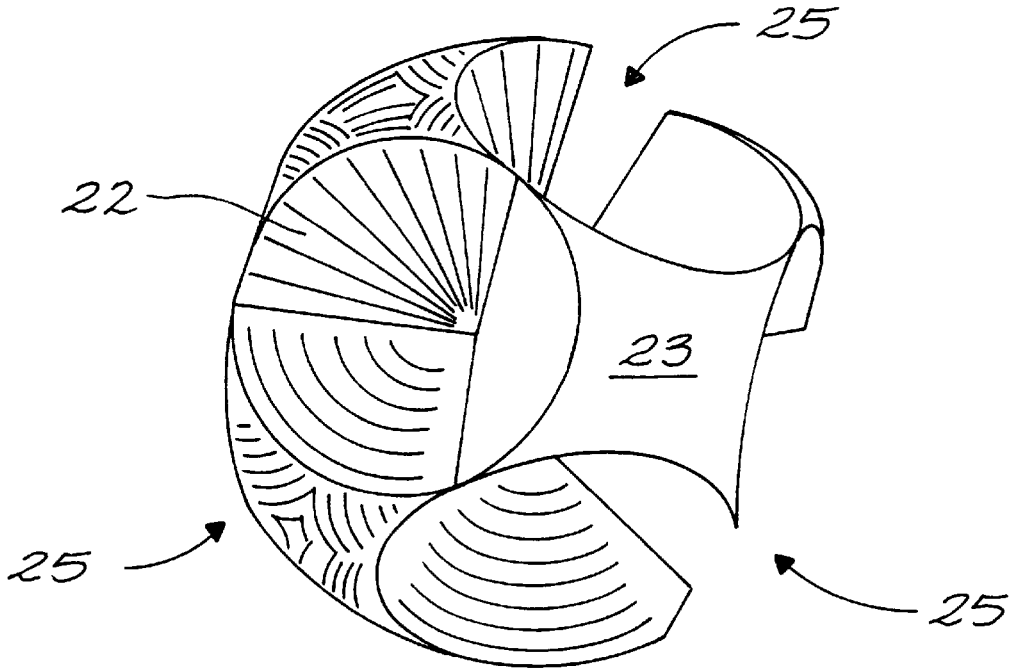
FIG. 9 is an isometric view of three of the blanks as shown in FIGS. 6 and 7 after the second step in assembly.

In the second step of assembly (FIG. 9), a third module 25 is fitted together with the two assembled modules from the first step with one peripheral edge area 24 overlapping the edge portion of central portion 23 and cones 22 partially overlapped. As noted above, these overlaps extend in two directions from each module and are alternated from one module to the next so that an interlock results that holds the final assembly of hollow figure 26 together as seen in FIG. 10.

Third, fourth, fifth and sixth steps are carried out in succession with one peripheral edge area 24 overlapping the edge portion of central portion 23 and cones 22 partially overlapped. Each module 25 has a peripheral edge area 24 overlapping the edge portion of central portion 23 of an adjacent module 25 on one side and in turn has an edge portion of central portion 13 overlapped by an edge portion 24 of an adjacent module on another side. The alternate overlapping on adjacent modules produces a self-supporting assembly. In assembling the modules 25 in this manner, not only are the portions 23 and 24 overlapped but also the cones are overlapped by about one-third on each side.

Figure 10:
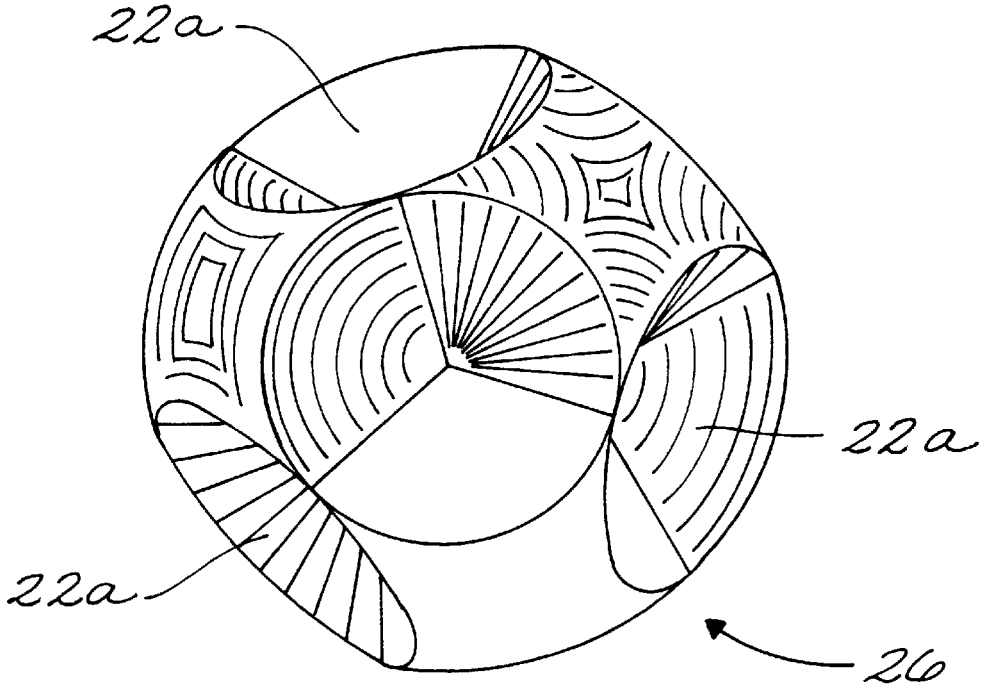
FIG. 10 is an isometric view of the completed hollow figure with symmetrical conical indentations formed after assembling six of the blanks in the same manner as the first and second steps shown in FIGS. 8 and 9.

The final assembly is shown in FIG. 10 where six of the modules 25 are assembled into hollow figure 26. The figure 26 has a substantially spherical shape on its outermost surface, approximating an octahedron in shape with cones 22*a,* formed by overlapping assembly of cones 22, extending inward of each corner of the octahedron.

The sequence of steps described above is more or less critical to the production of a hollow figure 16 with interior-facing cones 22*a* as shown and described above. The radius r of circular scoring 21 must be one half the height h of the rectangular card 20 and spaced along each edge thereof, but in the purest mathematical form the arcs are smooth curves that may differ from a true circle by up to 5% depending on whether one wants the bases of the cones to be planar.

While this invention has been described fully with reference to two preferred embodiments, it should be understood that within the scope of the appended claims, the invention may be practiced otherwise than as specifically described.

I claim:

1. A blank of foldable sheet material for assembling a hollow figure having inwardly directed conical depressions, comprising a sheet of foldable material having the shape of a square or rectangle, without interior cuts or exterior tabs scored or marked for scoring in four areas along circular lines tangential to each other and having a radius of one fourth the diagonal of the sheet if a square and one half the narrower side if a rectangle.

2. A blank according to claim 1 in which said sheet is square, and said circularly scored lines are centered one on each of the sides thereof.

3. A blank according to claim 1 in which said sheet is a rectangle, and two of said circularly scored lines are positioned on one of the longer sides thereof, and two of said circularly scored lines are positioned on another of the longer sides thereof, the radius of each circularly scored line being one half the length of the shorter sides of said rectangle.

4. A blank according to claim 1 additionally having said circularly scored areas formed into a conical shape comprising from about four-ninths to two-thirds of a cone.

5. A blank according to claim 2 additionally having said circularly scored areas formed into a conical shape comprising from about four-ninths to two-thirds of a cone.

6. A blank according to claim 3 additionally having said circularly scored areas formed into a conical shape comprising from about four-ninths to two-thirds of a cone.

7. A blank according to claim 1 in which said sheet of foldable material has a surface imprint or decorative coating on at least the portions thereof visible when assembled.

8. A blank according to claim 2 in which said sheet of foldable material has a surface imprint or decorative coating on at least the portions thereof visible when assembled.

9. A blank according to claim 3 in which said sheet of foldable material has a surface imprint or decorative coating on at least the portions thereof visible when assembled.

10. A hollow object comprising six of said blanks according to claim 2 assembled in overlapping relation of the edges thereof to form an assembled unit, said object having eight inward-directed cones uniformly spaced thereon.

11. A hollow object comprising six of said blanks according to claim 3 assembled in overlapping relation of the edges thereof to form an assembled unit, said object having eight inward-directed cones uniformly spaced thereon.

12. A method of assembling a hollow figure having inwardly directed conical depressions, comprising providing a sheet of foldable material having the shape of a square or rectangle, without interior cuts or exterior tabs scored or marked for scoring in four areas along circular lines tangential to each other and having a radius of one fourth the diagonal of the sheet if a square and one half the narrower side if a rectangle, forming said circularly scored areas into a conical shape comprising from about four-ninths to two-thirds of a cone, and assembling six of said blanks in overlapping relation of the edges thereof to form an assembled unit having eight inward-directed cones uniformly spaced thereon.

* * * * *